United States Patent [19]

Murdock

[11] Patent Number: 5,027,515

[45] Date of Patent: Jul. 2, 1991

[54] DRYWALL TWIN CUTTING BLOCK

[76] Inventor: Clifford R. Murdock, 2392 Printup Rd., Sanborn, N.Y. 14132

[21] Appl. No.: 376,644

[22] Filed: Jul. 7, 1989

[51] Int. Cl.[5] ..... B26B 29/06; B26D 3/08

[52] U.S. Cl. ..... 30/292; 30/293; 30/294; 83/885

[58] Field of Search ..... 30/164.95, 292, 293, 30/294; 83/883–885

[56] References Cited

U.S. PATENT DOCUMENTS

| | | | |
|---|---|---|---|
| 2,529,210 | 11/1950 | Butler | 83/883 |
| 2,706,002 | 4/1955 | Whittamore | 83/885 |
| 3,174,225 | 3/1965 | Abraham | 30/293 |

*Primary Examiner*—Hien H. Phan

*Attorney, Agent, or Firm*—Wallace F. Neyerlin

[57] ABSTRACT

A dry-wall cutting tool is described. It has a block-like configuration and is designed to slide over the edge of the drywall and to cut both sides of the drywall to the same distance from the edge and at the same time as it does so. The depth of the cut (i.e. distance from the edge of the drywall being cut) can be controllably varied considerably and it will typically be between ⅛ inch and 6 inches deep from the edge of the drywall that is being cut. The cutting tool has vertical threaded shafts upon which are mounted cutting wheels and rubber or nylon rollers, with ball bearings between the shafts and the cutting wheels and rollers. Due to its construction the twin cutting can be done quickly and with little manual effort or force.

12 Claims, 4 Drawing Sheets

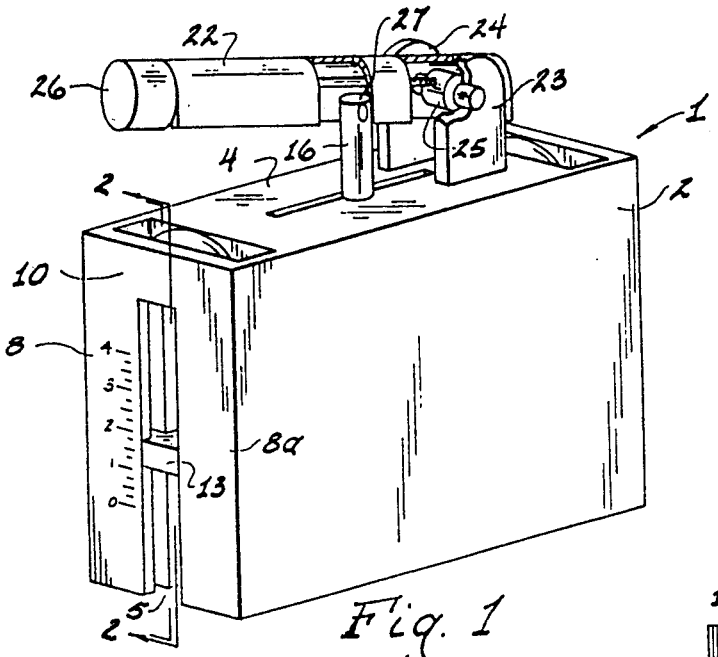
Fig. 1
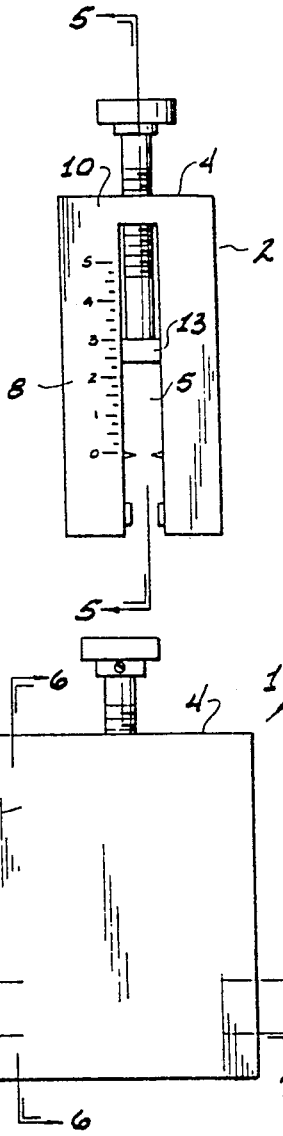
Fig. 3
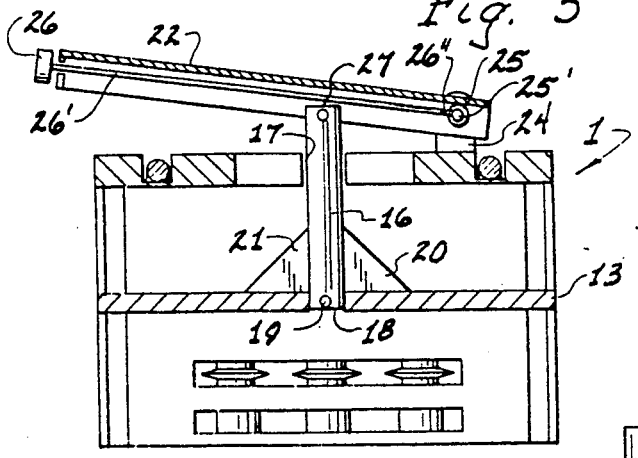
Fig. 2
Fig. 4
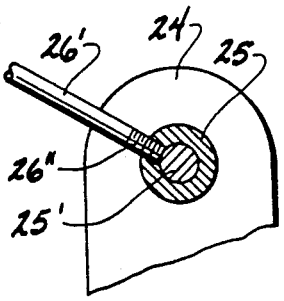
Fig. 2a

Fig. 13
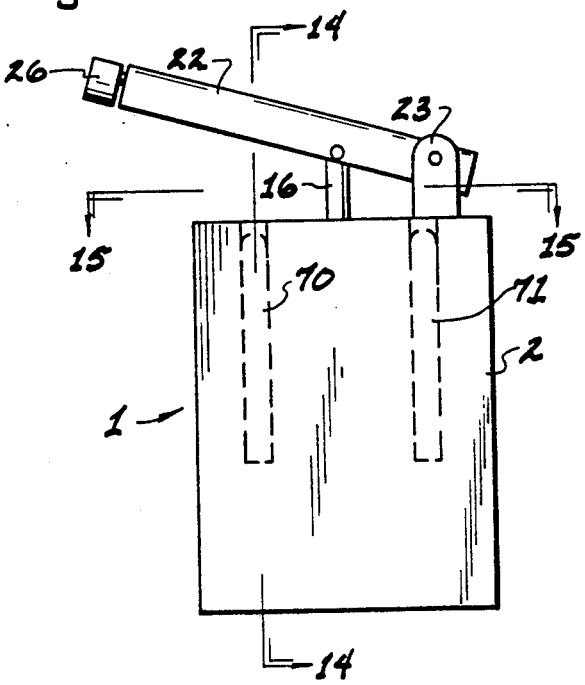
Fig. 14
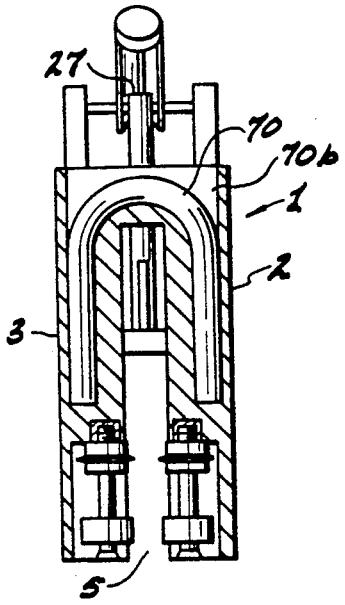
Fig. 15
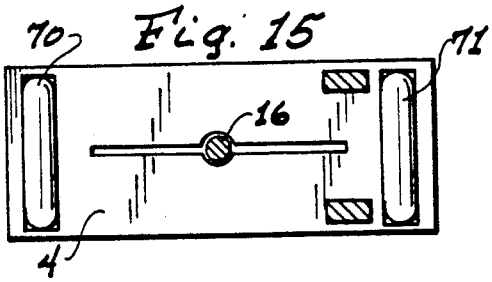
Fig. 16
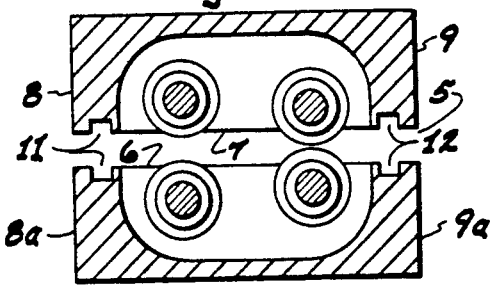
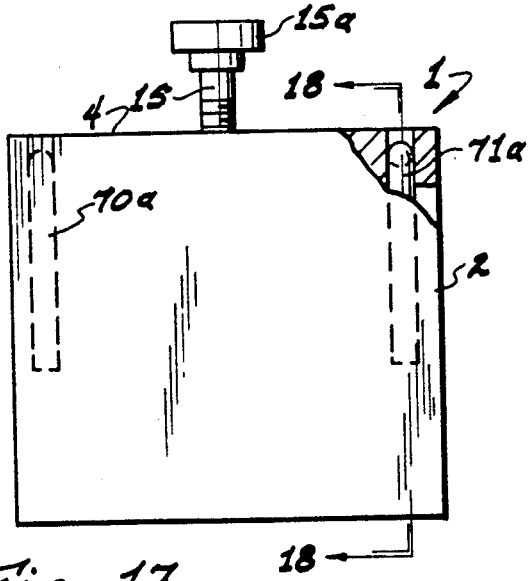
Fig. 17
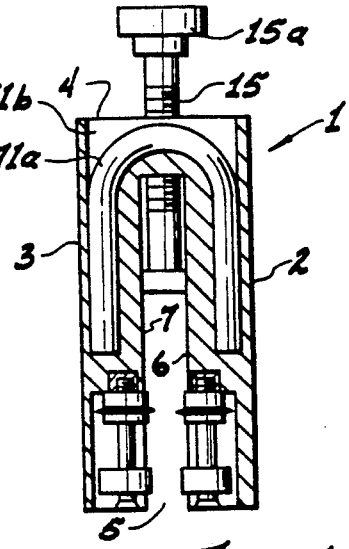
Fig. 18

DRYWALL TWIN CUTTING BLOCK

Field of the Invention

The following invention relates to a unique tool particularly useful for cutting drywall, wall board or other similar material as hereinafter discussed.

Background of the Invention

Drywall is typically used by contractors or homeowners to finish off the walls or ceilings of homes or other structures. Such drywall is typically manufactured in sheets measuring 4 feet by 8 feet and in thicknesses of ½ inch and ⅝ inches. In the construction business or industry such sheets also have other common dimensions measuring 4'×9'; 4'×10'; 4'×12'; 4'×14'; and 4'×16'. Such drywall sheets typically also have paper surfaces on each face thereof, enclosing the composition of the drywall between the faces.

When finishing off the said walls and ceilings of the structures being worked on to cover the framing and the joists etc., the contractor or worker will, of course, try to use as many entire 4×8 foot or other size sheets as he can, without trimming any material off the edges thereof. However, because of room dimensions, plans, or because of variances or variations brought about by errors in construction and/or sagging structures, etc., it is typically necessary to trim some of the material off one or more of the edges of the drywall before it can be mounted in place where it is desired.

Heretofore, the most common practice in carrying out this trimming operation has been for the trimmer to draw a line on the edge of the drywall and then "score" along one side of the drywall with a sharp knife or blade and then flex the portion of the drywall edge to be cut away from the main body of the drywall. Such practice is time consuming and inefficient and also frequently results in an uneven edge line on the desired portion of the drywall that is to be mounted on the wall or ceiling. The present invention is addressed to overcoming the foregoing problems and simultaneously to accomplish same with a novel and unique cutting device for doing so.

Summary of the Invention

The cutting tool of this invention can be described as a twin cutting block; that is, it has a block-like configuration and is designed to slide over the edge of the drywall and as it does so it will cut both sides of the drywall to the same distance from the edge and at the same time. The depth of the cut (i.e. distance from the edge of the drywall being cut) can be controllably varied considerably and it will typically be between ⅛ inch and 6 inches deep from the edge of the drywall that is being cut. The twin cutting can be done quickly and with little manual effort or force. These are its main advantages over the use of a drywall cutting knife or blade. The cutting block also preferably has at least 4 and, more preferably, 6 to 8 sharp cutting wheels and as the tool slides along the edge of the drywall, the wheels do the cutting.

Objects of the Invention

Accordingly, it is a principal object of the invention to overcome the aforedescribed disadvantages of trimming drywall using a cutting knife on a single side thereof.

It is another object of the invention to accomplish same in a work-saving manner and to carry out such trimming at a depth of cut (i.e. distance from edge) which at the same time is controllably accurate but capable of being varied considerably in depth.

It is another object of the invention to trim drywall faster and with a cleaner cut to save worker or contractor time and to accomplish the cutting of the drywall from both sides thereof and at the same distance from its edge and at the same time.

It is yet another object of the invention to provide a cutting apparatus having novel features of construction which enable it to carry out the foregoing objectives, as well as enable it to perform similar cutting or trimming operations on other types of materials as hereinafter are referred to.

Brief Description of the Drawing Figures

Referring now to the attached drawings;

FIG. 1 is a front and side vertical perspective view of the twin cutting block of the invention, illustrating also, at the top thereof, one particular means for controlling the depth of the cut to be made in the drywall.

FIG. 2 is a vertical cross-sectional view of the device of FIG. 1 as taken across the line 2—2 thereof.

FIG. 2*a* is an expanded view of portions of FIGS. 1 and 2 to illustrate more clearly the means used in the device of these Figures to control the depth of the cut to be made in the drywall.

FIG. 3 is a front vertical perspective view of the cutting block, illustrating a different particular means for controlling the depth of the cut to be made in the drywall.

FIG. 4 is a side vertical perspective view of the cutting block illustrated in FIG. 3.

Figure 5:
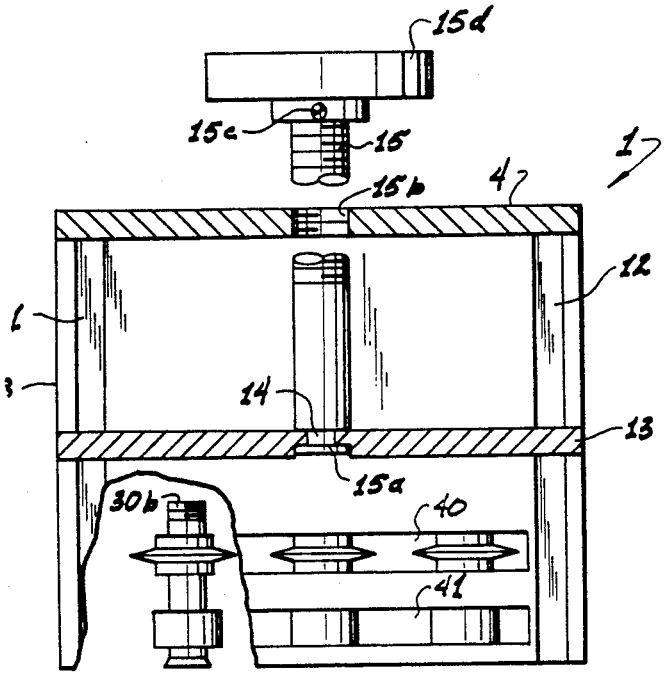

FIG. 5 is a vertical sectional view of the device of FIG. 3 as taken across the line 5—5 thereof.

Figure 6:
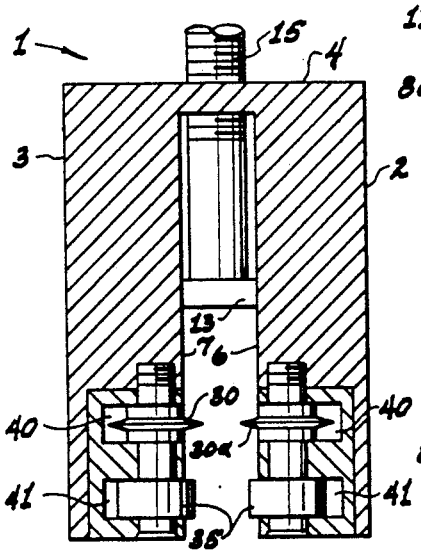

FIG. 6 is a vertical cross-sectional view of the device of FIG. 4 taken across the lines 6—6 thereof.

Figure 7:
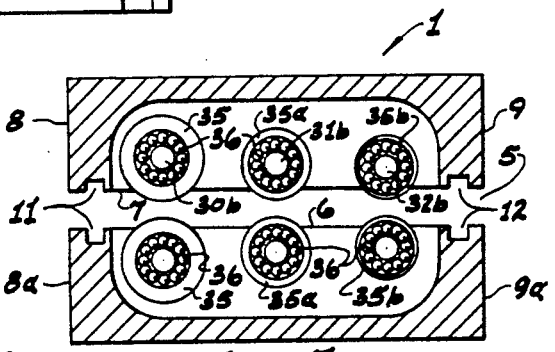

FIG. 7 is a horizontal cross-sectional view of the device of FIG. 4 as taken across the lines 7—7 thereof.

Figure 8:
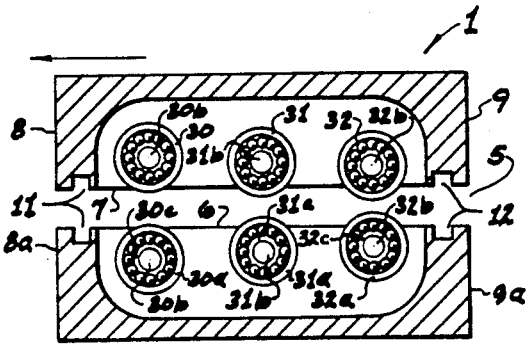

FIG. 8 is a horizontal cross-sectional view of the device of FIG. 4 as taken across the line 8—8 thereof.

Figure 9:
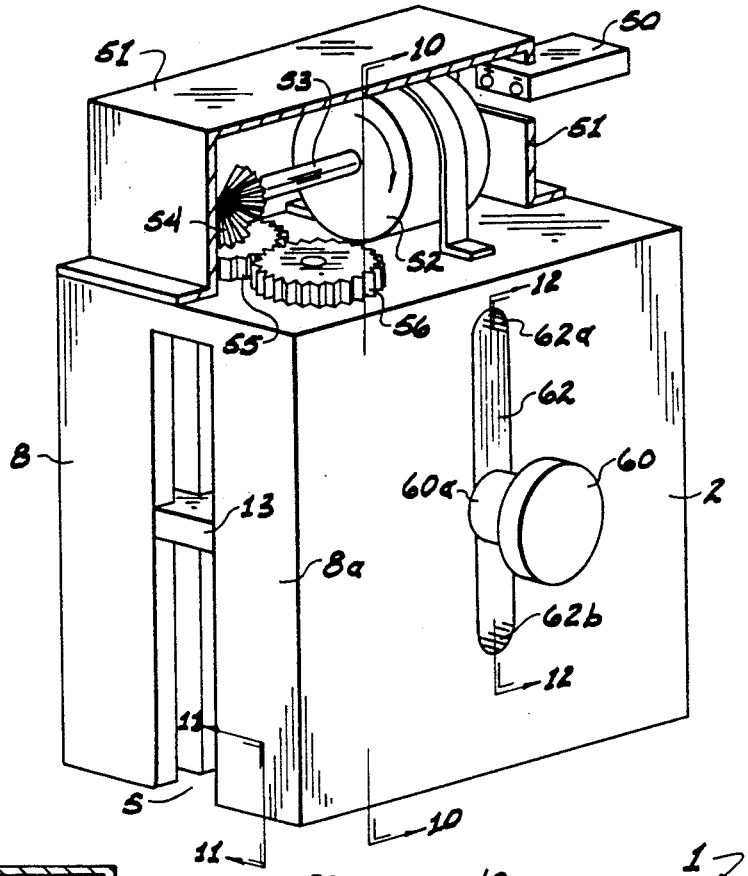

FIG. 9 is a front and side vertical perspective view of another embodiment of the invention set forth to illustrate how the cutting block may be operated electrically rather than manually.

Figure 10:
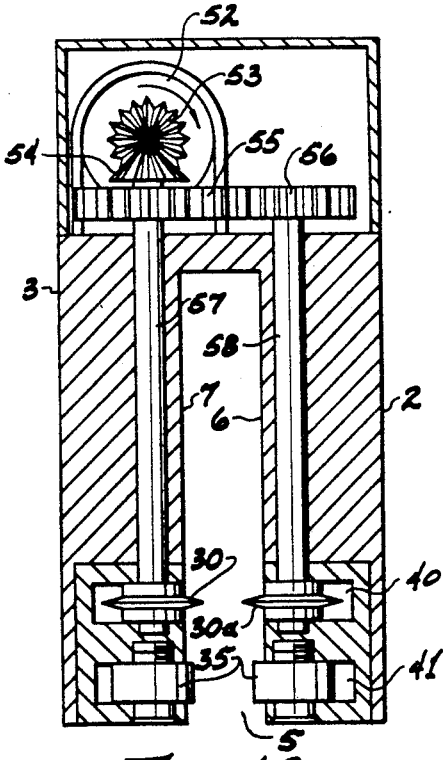

FIG. 10 is a vertical cross-sectional view of the device of FIG. 9 as taken across the line 10—10 thereof.

Figure 11:
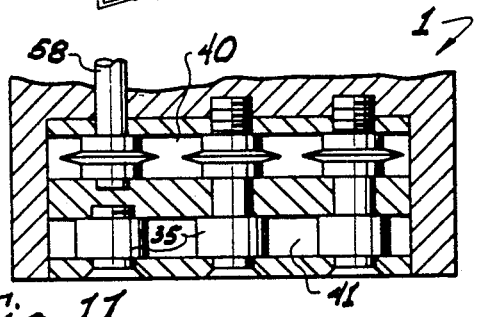

FIG. 11 is a partial vertical cross-sectional view of the device of FIG. 9 as taken across the line 11—11 thereof.

Figure 12:
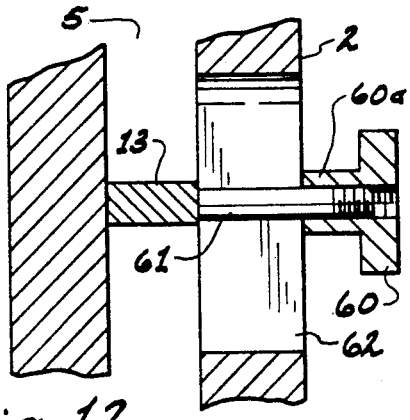

FIG. 12 is a partial vertical cross-sectional view of the device of FIG. 9 as taken across the line 12—12 thereof.

FIG. 13 is a side vertical perspective view of the cutting block illustrated in FIG. 1 and illustrates a means for reinforcing the side walls of the cutting block as described hereinafter.

FIG. 14 is a vertical cross-sectional view of the device of FIG. 13 as taken across the lines 14—14 thereof.

FIG. 15 is a horizontal cross-sectional view of the device of FIG. 13 as taken across the lines 15—15 thereof.

FIG. 16 is a horizontal cross-sectional view of any of the devices of the invention when utilizing the embodiment of only two pair of opposing cutting wheels.

FIG. 17 is a side vertical perspective view of the cutting block of FIG. 3, but additionally illustrating a means for reinforcing the side walls of the cutting block as described hereinafter; and FIG. 18 is a vertical cross-sectional view of the device of FIG. 17 as taken across the lines 18—18 thereof.

Detailed Description of the Drawings

In FIG. 1 and all of the Figures, the twin cutting block is designated generally by the numeral 1. The cutting block has side walls, 2 and 3, a top 4, a passage or channel 5 between the inner faces of the side walls, and end walls 8, 8*a*, and 9, 9*a*, at opposite ends thereof. Each end wall is in the shape of an inverted rectangular , with the horizontal leg of same forming a solid bridge 10 at each end of the cutting block, to provide rigidity of structure for the block.

The opposite solid end portions of the block each possess rectangular shaped slots or channels 11 and 12 therein which extend from near the top of the block all the way to the base of the block in each end thereof. These channel openings in the ends, together with channel 5 between the inner faces 6 and 7 of the side walls of the block make possible the utilization of a top plate member 13 which may be raised and/or lowered in said channels to butt against the edge of the dry wall piece to be cut. This top plate member will typically be made from steel in a thickness of at least about one inch so as to provide the firmness and absence of flexing or bending desired to assure nicely controlled cutting of the dry wall material. This is also necessary in order to enable it to be rigidly connected to the raising and lowering means for same as are illustrated in FIGS. 1 and 3.

In FIG. 5, top plate 13 possesses a shouldered recess 14 therein at or near its mid-point where shown and threaded rod 15 is rotatably coupled into same by having its lower end flared into a flat plane 15*a* after being inserted through recess 14; after which the top end of rod 15 is threaded through a threaded opening 15*b* in the top 4 of the cutting block. Rod 15 will typically have a diameter of 7/16" and will also have a comfortably graspable end member 15*d* attached thereto by set screw 15*c* for efficiently and conveniently threading the rod 15 through top opening 15*b* in order to raise or lower the top plate to the desired level in the cutting block. For convenience and accuracy in setting same, end wall 8 is calibrated to show the depth of the cut that will be made in the dry wall when the top plate is set at a given level.

In FIGS. 1 and 2, instead of using a threaded rod (as is done in FIGS. 3, 4, 5 and 6) to control the depth of the cut to be made, a piston-cylinder type arrangement is used. This arrangement comprises rod or piston 16 that slides through cylindrical hole opening 17 in the top 4 of the cutting block. Rod 16 is connected to the top plate 13 at area 18 such as by means of a transverse stud 19 going through a cylindrical hole in the top plate and in the rod 16; and also by means of stabilizing support arms 20 and 21 fixed, such as by welding, to portions of the top plate as shown in the drawing. The combination assures firm and rigid abutment against the edge of the drywall when the block is used to cut same. Hand lever control arm 22 is used to exert force against the top 27 of rod 16 so as to also assure firm contact of the top plate against the drywall edge. Stanchions 23 and 24, affixed to the top 4 of the block, in conjunction with transverse axle-like member 25' and hand lever 22 provide lever-type mechanical advantage control for adjustment of the top plate, the operator utilizing knob control 26 of shaft or rod 26' in accomplishing same.

In FIGS. 1, 2 and 2*a*, sleeve or collar 25 is free to rotate around axle (pin) 25' which is fixed in stanchions 23 and 24. Rod 26' is fixed in knob 26 and has threaded end 26". Turning knob 26 causes threaded end 26" to advance through a female threaded hole in sleeve 25 and press against pin 25', thus tightening 25'; the handle assembly (22, 26, 26', 26") and thus 16 and 13 are held in any position.

In a rudimentary form, the apparatus can be designed and operated with a single set of razor sharp cutting wheels opposite each other in the inner faces of the cutting block. However, in a preferred embodiment, the cutting block preferably has at least four cutting wheels, as shown in FIG. 16, and more preferably and as illustrated in FIGS. 2, 5, 8, and 11, three such sets of opposing cutting wheels are employed. With such a cutting block, cutting of the dry wall whose edge is being cut is carried out by moving the cutting block in the direction of the arrow of FIG. 8. The dry wall is held in a stationary position by the user of the cutting block and the cutting block is centered over the dry wall so that channel 5 of the cutting block encloses the dry wall and the top plate of the block butts against the edge of the dry wall, after adjustment of the top plate has been made to carry out the depth of cut desired. The cutting block is then moved in the direction of the arrow until cutting wheels 30 and 30*a* contact same, at which time the wheels cut into the dry wall to the extent indicated in FIG. 8 that they protrude into channel 5. As the cutting block is further slid over the edge of the dry wall, cutting wheels 31 and 31*a* cut into the dry wall to the extent indicated in FIG. 8; and as the cutting block is further slid over the edge of the dry wall, cutting wheels 32 and 32*a* further cut into same to the extent indicated in FIG. 8. It should be appreciated that the amount of cutting done by the razor sharp cutting wheels as shown in FIG. 8 is illustrative only and not limitative. For example, it may be desirable that initial cutting wheels 30 and 30*a* take a deeper cut into the dry wall than as is illustrated; and/or that cutting wheels 32 and 32*a* come closer together so that they almost touch in the last cutting of the dry wall or any other material being cut. (Adjustable depth of cut desired is also as illustrated in FIG. 16.)

The cutting wheel sets are mounted, as shown in FIG. 8, on vertical support members 30*b*, 31*b* and 32*b* which are externally threaded, as illustrated in FIGS. 5 and 6; and the internal ends of which are threaded into internal threaded openings in the inner walls of the cutting block, toward the top thereof. Ball bearing bushings 30*c*, 31*c* and 32*c* are utilized between the vertical support members and the razor sharp cutting wheels to avoid or minimize frictional resistance during the cutting step and to enable the equal cutting of the dry wall by all portions of the circumference of the cutting wheels.

Movement of the cutting block across the edge of the dry wall while simultaneously cutting same is also facilitated by the utilization of rubber rollers 35, 35*a* and 35*b* which are also mounted on the vertical support rods 30*b*, 31*b* and 32*b*, as illustrated in FIG. 5 and FIG. 7. Ball bearings 36 are also utilized between these rollers and the vertical supports on which they are mounted to facilitate the easy rotation of these rollers as the cutting block is pushed across the edge of the dry wall being cut.

When the cutting wheels have the same diameter, as is preferred and as is illustrated in FIG. 8, then the roller size's diameters have to differ as illustrated in FIG. 7; and the center lines of the supporting shafts 30*b*, 31*b* and 32*b* upon which the cutting wheels and rubber rollers are mounted also must be moved from parallel to opening 5 to a small angular position with respect to same; as also illustrated in FIGS. 7 and 8.

FIGS. 5, 6, 7 and 8, and 10 and 11, primarily illustrate the positioning of the vertical support rods 30*b*, 31*b* and 32*b* in the sidewalls of the twin cutting block. The side walls have three sets of opposing rectangular recesses 40 and 41 therein to accommodate, respectively, room for the sharp cutting blades and the mountings for same and room for the rubber rollers 35 and mountings for same (see FIG. 6). Housings 40 and 41 are substantially impervious to the dry wall or other material being cut. It will be appreciated that the inner walls of the twin cutting block are wide enough to easily accommodate holes therein for the threading of the vertical support rods therein without materially reducing the strength of the cutting block.

The apparatus, to carry out its cutting function, must necessarily be substantially rigid and, consequently also, fairly heavy. Basic design modifications are now described that help to alleviate problems that might arise for the user of the apparatus, due to its weight, if he is to use it for an extended period of time and possibly get tired for this reason.

As previously indicated, FIG. 9 illustrates an embodiment that makes possible the electrical operation of the device. Rather than the user having to push the device across the edge of the drywall and cut it by the use of his manual force, all that the operator of the device of FIG. 9 has to do is center the device in the same manner as previously described, and push a switch and hold the device over the edge of the drywall while the electricity of the apparatus provides the energy to do the cutting.

The device of FIGS. 9 and 10 draws its electrical power from battery 50 which is suitably mounted and attached to bracket 51 affixed to the top 4 of the cutting block. By suitable electrical connections, battery 50 energizes light motor 52 which drives geared shaft 53 which drives gear 54 which, in turn, drives gears 55 and 56. Gears 55 and 56 are connected to shafts 57 and 58 to which are attached cutting wheels 30 and 30*a* thereby causing these cutting wheels to rotate when the switch or button (not shown) activating battery 50 is pushed.

FIG. 11 illustrates the different arrangement of support shafts which is required when the FIG. 9 embodiment of the invention is utilized, as compared to the FIG. 6 arrangement in which no support rod is activated for rotation.

The depth of the cut taken using the device of FIG. 9 is illustrated in FIG. 12 and is controlled by raising plate block 13 up or down in channel 5. The means for accomplishing this is through internally threaded control knob 60 coupled to externally threaded shaft 61 which is suitably engaged (not shown) to plate block 13, as illustrated in FIGS. 9 and 12. Knob 60 possesses a cylindrical collar 60*a* which prevents it from going into vertical adjustment slot 62, but which, at the same time enables 60*a* to butt firmly against wall 2 of the cutting block after shaft 61 engages plate block 13. Loosening knob 60 from shaft 61 enables re-positioning of plate block 13 anywhere as desired in channel 5, except as limited by the upper and lower ends 62*a* and 62*b* of slot 62.

With regard to the previous cutting blocks described, the side walls 2 and 3 are typically fabricated from a heavy metal such as iron or steel; and, as previously indicated, such a heavy device may tend to tire the user if he is to use it for an extended period of time. The embodiments of the invention illustrated and now described in FIGS. 13–15 and 17–18 exemplify means for easing or overcoming this possible problem, as another alternative besides the electrical drive means illustrated in FIGS. 9–12.

In the devices of these Figures, the side walls 2 and 3, which typically account for more than 50% of the overall weight of the cutting block, may be fabricated from a relatively light weight material, such as aluminum typically. Because the bottom legs of the block which contain the cutting wheels and the vertical supports for same must be fairly strong in order that ends 8 and 8*a* and 9 and 9*a* may preserve channel 5 as a rigid rectangular opening, the blocks of these devices are reinforced with horseshoe-shaped iron or steel members 70 and 71 (in the embodiment of FIGS. 13 and 14); or 70*a* and 71*a* (in the embodiment of FIGS. 17 and 18.) Such reinforcing members are located in the twin cutting blocks in channels 70*b* and 71*b* located near the ends 8, 8*a* and 9, 9*a* respectively in either version of the cutting block.

The use of such horseshoe-shaped reinforcing members in combination with a light weight material such as aluminum or rigid plastic is estimated to reduce the overall weight of the cutting block by at least 25%.

Although the twin cutting block or apparatus of the present invention has been discussed primarily in connection with its utility for cutting dry wall such as has been previously described herein, and although this is the preferred use for same, it should be appreciated that the device can beneficially be used to cut several other materials. Factors to be considered in determining whether the cutting block would be suitable for cutting same are primarily whether the material is of sufficient thickness and strength so that its edge, against which the top plate of the device butts, can withstand the force exerted against it as the device is pushed across said material to cut same; and whether the material can readily be cut through by the razor sharp cutting wheels as the device is pushed across said material to cut same. Examples of other materials which can advantageously be trimmed by the twin cutting block of the present invention are: sheet rock, gypsum board, wallboard, peg board, gyp rock, paneling, chip board, plywood overlay or underlay, vinyl siding, rigid styrofoam and wall molding. All materials will preferably be at least ⅛ inch thick in order to have the minimum rigidity required in order to cut the material along a straight line, i.e. to a uniform depth from the edge of the material being cut. In some cases, e.g. where the material to be cut is very strong such as hard wood sheets of paneling or plywood underlay or overlay it is preferable that the material have a thickness no greater than about ⅛" inches for the device to be useful for cutting same; whereas, with other materials such as rigid styrofoam, it is preferable because of its relative fragileness that it, have a thickness of at least about ½ inch in order for the cutting block to be useful to cut same.

It will be appreciated that the foregoing specification and the accompanying drawings are set forth by way of illustration and not limitation, and that various modifications and changes may be made therein without departing from the spirit and scope of the present invention which is to be limited solely by the scope of the appended claims.

I claim:

1. An apparatus suitable for cutting a precisely controlled desired depth of dry wall from one of the edges thereof as the apparatus is pushed across the edge of the dry wall being cut, the main body of said apparatus being in the form of a block having a top and side walls and end walls and having a channel therein between the side walls, the width of said channel being only slightly greater than the thickness of the dry wall to be cut, said apparatus having a top plate which is controllably raised or lowered in the channel so as to butt up against the edge of the dry wall to be cut, and said apparatus having cutting wheels in the opposing interior faces of the channel so as to simultaneously cut the dry wall on both sides of same as the apparatus is pushed across the edge of the dry wall being cut, said cutting wheels being supported on vertical threaded shafts, with ball bearing bushings housed between the shafts and the cutting wheels and said threaded shafts also supporting rubber or nylon rollers, with ball bearing bushings housed between the shafts and the rollers.

2. An apparatus according to claim 1 wherein the main body of the apparatus is made of steel and the cutting wheels are made from stainless steel with razor sharp edge.

3. An apparatus according to claim 1 wherein the cutting wheels are six in number, three in each side of the channel and directly opposite those on the other side and wherein the wheels are so positioned in the apparatus that each successive set of opposing wheels takes a cut in the drywall slightly deeper than the previous set of opposing wheels.

4. An apparatus according to claim 3 where the set of opposing cutting wheels that takes the first cut in the drywall is electrically motorized.

5. An apparatus according to claim 1 wherein said top plate is controllably raised or lowered by means of adjustment of an externally threaded rod rotatably connected at the underside of the top plate and threaded through an internally threaded hole in the top of the apparatus.

6. An apparatus according to claim 1 wherein the cutting wheels are four in number, two in each side of the channel and directly opposite those on the other side and wherein the wheels are so positioned in the apparatus that the successive set of opposing wheels takes a cut in the drywall deeper than the previous set of opposing wheels.

7. An apparatus according to claim 6 wherein the set of opposing cutting wheels that takes the first cut in the drywall is electrically motorized.

8. An apparatus according to claim 1 wherein an end wall of the apparatus contains a calibration scale to show the depth of the cut that will be made in the dry wall when the top plate is set at a given level.

9. An apparatus according to claim 1 wherein the cutting wheels which are in the opposing interior faces of the channel and which are surrounded by ball bearing bushings are in a housing impervious to the dry wall material being cut.

10. An apparatus according to claim 1 wherein the main body portion of said apparatus is constructed of aluminum metal and wherein the ends of the apparatus contain inverted U-shaped steel rod supports so as to reinforce the strength of the cutting apparatus.

11. An apparatus according to claim 1 wherein the cutting wheels are of the same diameter and the rollers have different diameters.

12. An apparatus according to claim 1 wherein said top plate is controllably raised or lowered by means of adjustment of a piston-cylinder hand-lever type arrangement, said arrangement including a cylindrical rod that goes up or down through a cylindrical hole in the top of the cutting apparatus and said rod being attached to the top plate.

* * * * *